US005284042A

United States Patent [19]

Benedetti

[11] Patent Number: 5,284,042

[45] Date of Patent: Feb. 8, 1994

[54] METHOD TO OBTAIN SECTIONS AND/OR BARS IN THE COLD STATE, AND SECTIONS AND/OR BARS THUS OBTAINED

[75] Inventor: Giampietro Benedetti, Campoformido, Italy

[73] Assignee: Danieli & C. Officine Meccaniche SpA, Buttrio, Italy

[21] Appl. No.: 884,176

[22] Filed: May 18, 1992

[30] Foreign Application Priority Data

May 27, 1991 [IT] Italy ..... 91A000090

[51] Int. Cl.[5] ..... B21B 1/12; B21D 28/26

[52] U.S. Cl. ..... 72/204; 72/365.2

[58] Field of Search ..... 72/203, 204, 221, 365.2

[56] References Cited

U.S. PATENT DOCUMENTS

| | | | |
|---|---|---|---|
| 845,764 | 3/1907 | Curtis | 83/332 |
| 1,977,285 | 10/1934 | McCleery . | |
| 4,201,075 | 5/1980 | Chumanov et al. | 72/204 |
| 4,872,330 | 10/1989 | Nonini | 72/203 |

FOREIGN PATENT DOCUMENTS

| | | | |
|---|---|---|---|
| 750785 | 6/1933 | France . | |
| 54-33252 | 3/1979 | Japan . | |
| 57-58902 | 4/1982 | Japan . | |
| 60-06202 | 1/1985 | Japan . | |
| 0130404 | 7/1985 | Japan | 72/204 |
| 0229402 | 10/1986 | Japan | 72/204 |
| 0011001 | 1/1989 | Japan | 72/204 |
| 1026850 | 7/1983 | U.S.S.R. | 72/204 |
| 1310045 | 5/1987 | U.S.S.R. | 72/204 |
| 306 | of 1910 | United Kingdom . | |
| 1355144 | 5/1974 | United Kingdom . | |

*Primary Examiner*—Lowell A. Larson
*Assistant Examiner*—Thomas C. Schoeffler
*Attorney, Agent, or Firm*—Antonelli, Terry, Stout & Kraus

[57] ABSTRACT

Method to obtain simultaneously in the cold state a plurality of sections and/or bars (14), starting with a hot-rolled single multiple-section element (10) which is then cooled (12), the sections and/or bars (14) being deemed to be small sections and/or bars (14) in relation to the typical dimensional category of the specific rolling mill (11), the single multiple-section element (10) comprising a plurality of sections and/or bars (14) which have a symmetrical, asymmetric or special cross-section, a web (23) possibly being included between one section and/or bar (14) and another, the hot-rolled single multiple-section element (10) being cooled (12) in line with the rolling mill (11) and then undergoing, without a break of continuity, an operation in the cold state of simultaneous lengthwise splitting (13) to separate the individual small sections and/or bars (14). The single multiple-section element and the resulting individual sections are also protected.

14 Claims, 4 Drawing Sheets fig.2b"

fig. 2c"

METHOD TO OBTAIN SECTIONS AND/OR BARS IN THE COLD STATE, AND SECTIONS AND/OR BARS THUS OBTAINED

BACKGROUND OF THE INVENTION

This invention concerns a method to obtain a plurality of sections and/or bars (long products) in the cold state at one and the same time; the invention concerns also the sections and/or bars thus obtained.

The method consists in obtaining from a hot rolled product a multiple-section element including a finished plurality of sections and/or bars, in cooling this multiple profile in a production line and in arranging to split the various sections and/or bars in the cold state at one and the same time without interrupting continuous production.

To be more exact, this invention concerns a method for obtaining simultaneously in the cold state a plurality of sections and/or bars of long products from one single multiple-section element having a special multiple profile produced in a hot rolling mill, with the plurality of sections or bars joined together lengthwise by webs.

Nowadays, the hot rolling mills to obtain long products in particular, and not only those which serve to obtain sections, are sized on the basis of the hourly capacity of the heating furnaces, the power of the drive motors, the rolling mill stands, the transmission means and the lubrication and cooling services; moreover, they have to take account of the desired output and the rolling stresses generated by the thicker sections.

It follows that, when a given rolling mill is producing smaller sections or the smallest sections, the conversion costs increase appreciably because the plant is not employed correctly with the technology of the state of the art.

For this reason rolling plants are dimensioned in relation to a limited dimensional range of products so that the rolling mill will provide an acceptable average efficiency in relation to the sizes processed.

The plants therefore are designed, in fact, specially and are classified according to the four dimensional categories of sections and/or bars; these dimensional categories are defined as small, medium, heavy and extra-heavy sections and/or bars.

This means that, to cover a broad slice of the market in a reasonable and adequate manner, a producer is compelled to have a plurality of hot rolling plants so as to be able to produce economically more than one dimensional category of sections and/or bars.

A producer who has one given rolling plant will have to be content with producing only that specific dimensional category of sections and/or bars.

The state of the art includes the hot rolling of two or more small sections at the same time; these small sections are hot rolled at the same time while forming one single element which comprises these sections joined together lengthwise.

Immediately after the hot rolling these small sections are split from each other lengthwise in the hot state in the rolling mill itself.

These small sections and/or bars thus split in the hot state create great handling problems because they cannot be controlled adequately in the three-dimensional positioning they take up. These problems occur mainly in the braking services, in the cooling, in the measuring, in the separation, in the preparation of layers of the sections and/or bars, in the feed to the straightening process and generally in all the other processes downstream of the hot rolling and splitting.

The reason for this is that the automatic handling of a plurality of bars and/or sections in the hot state arriving at the same time in the services downstream of the hot rolling and splitting leads to piling up, twisting, uneven cooling, misalignments, bending, etc.

This entails severe problems as regards production, design, construction, use and running and also safety. The state of the art requires also a great number of persons employed in the services downstream of the hot rolling and splitting since the automation of the operations of finishing, packaging and possible quality control in-line in the plant manufacturing long finished products becomes complex, complicated and not always capable of being resolved satisfactorily.

SUMMARY OF THE INVENTION

So as to overcome all these technical problems, reduce the necessary labour force and meet the urgent and, for some time now, widely expressed market requirement for an ever greater flexibility of production and to be able to lessen the investment costs for new plants and/or modernization of existing plants, the present applicants have surprisingly recognized the possibility of widening, to include smaller dimensions, the typical dimensional range of the products which can be made on a rolling mill.

In other words by means of the invention it is possible to widen, to include smaller dimensions, the range of the cross-sections of the sections and/or bars which can be made on a given hot rolling plant without reducing the production capacity of the same plant.

The invention therefore makes possible the widening, to include smaller dimensions, of the typical dimensional range while keeping intact the economical and competitive capacity of the plant.

In actual fact the present applicants have surprisingly recognized the possibility of widening, to include smaller dimensions, the typical dimensional range of the products which can be made on a rolling plant by including smaller dimensions in the dimensionally typical range.

The invention therefore has the purpose of making competitive the production of sections and/or bars which can be made on a given hot rolling mill by increasing the hourly output of the rolling mill and at the same time widening, to include smaller dimensions, the extent of the dimensional range which can be processed on that particular rolling plant without substantially derating the hourly output of the plant.

In fact, such a derating would entail an increase of the conversion costs and would make uneconomical the inclusion, within the range of products to be made, of those dimensions which are smaller than the nominal minimum size of the typical dimensional range for that given rolling mill.

This widening of the range of products enables sections and/or bars to be included which have smaller dimensions than the nominal minimum dimensions provided for on a given rolling mill.

This is achieved without impairing the production capacity of the plant, which is dimensioned on the basis of the desired hourly output of heavier sections. The invention has the purpose of fulfilling this result without reducing appreciably and substantially the production per hour and without having to forego the automation of the production cycle.

The invention has the further purpose of reducing the types of rolling plants, whether new or already in use, which are indicationally divided into small, medium, heavy or very heavy plants.

In a given rolling mill the invention can produce continuously at competitive costs a wider dimensional range, including smaller dimensions, of sections and/or bars and at the same time achieves a better exploitation of the potential of the plant itself.

As a non-restrictive example, the invention makes possible the continuous production of small and medium sections and/or bars or of small, medium and heavy sections or again of medium, heavy and very heavy sections in one single plant while keeping the average output high and without having the typical problems encountered in the finishing zone.

In the description which follows we shall mention small sections and/or bars, but it remains clear that this definition shall be understood in relation to the particular rolling mill and to the typical dimensional range which is normally made on that particular rolling mill.

Thus, for instance, in a rolling mill to roll sections ranging between fifty and one hundred and sixty millimeters, a small section according to the invention means a section of about fifty millimeters or less down to the minimum market values of eight to ten millimeters.

According to the invention a hot rolling mill rolls at one and the same time one single element in the hot state consisting of a plurality of small sections, whether they be symmetrical, asymmetrical or specials joined together lengthwise along an edge.

According to a variant two Contiguous edges 0 two contiguous sections are connected together by a web.

Asymmetrical sections according to the invention are rolled with care being taken that their arrangement should be such as to enable the thrusts to be controlled so as to be substantially eliminated, for thrusts, which are considerable, occur when such asymmetrical sections are rolled individually.

The single multiple-section element produced in the hot state by the rolling mill according to the invention is then cooled in-line with the rolling train.

This cooling may also be combined with possible thermal or other treatments, which may be carried out with air, water or another system able to cool the multiple-section element in the required method and time.

According to a variant, during the rolling step or immediately after the hot rolling of the single multiple-section element, slits or pre-slits are made along the nominal lines of splitting of the individual sections and/or bars or along the nominal lines of splitting of a section with its relative web. These slits or pre-slits may be continuous or discontinuous.

The slits, if they are discontinuous and therefore made only along segments, may be through slits, so that two single contiguous sections and/or bars are joined together side by side at points and along separated segments.

This multiple-section element consisting of this plurality of sections and/or bars formed as one single element, when it has been cooled and immediately after it has emerged from the cooling assembly, which may be a cooling plate for instance, undergoes an operation of simultaneous lengthwise splitting of the individual small sections and/or bars constituting the single multiple-section element. This enables a plurality of sections to be obtained with one single operation.

This operation of splitting the now cold individual sections defined in the one single multiple-section element containing the plurality of sections is advantageously performed on the multiple-section element in the cold state but without interruption of continuity i relation to the hot rolling mill or the cooling system.

The splitting action can be carried out either by laser or by slitting rolls or by oxygen lancing, etc., an operation of lengthwise slitting alone being advantageous because owing to its characteristics it has the least possible effect on the section and/or material.

According to the invention each single section undergoes a cold operation of reshaping or trimming of its edge and of cold straightening, depending on the type of section and/or bar or on the composition of the sections and/or bars and the connection system (continuous or discontinuous) employed to join the plurality of sections side by side. These operations performed in the cold state may take place on all the sections at the same time.

According to a variant which is not preferred the operations to trim the edges and straighten the sections may be carried out individually, section by section.

Working continuity is maintained advantageously so as to avoid stoppages or slowing down.

Next, the sections undergo a possible shearing-to-size operation.

Where connecting webs are included between edges of the sections, these webs are sheared for scrap by a flying shears after they have been detached.

According to a variant the splitting and straightening operation according to the invention is carried out at one and the same time by pulling the individual sections apart during the straightening step and thus, in fact, causing a lengthwise slit by tearing or by assisting the slitting operation also by the effect of the tearing action.

This simultaneous multiple operation of splitting by tearing and of straightening can be accomplished mainly where the pre-slits made in the hot state are through slits and where the single sections are joined together only at points.

According to a variant this multiple operation of splitting and straightening at the same time is also performed where the pre-slit made in the hot state is not a through pre-slit.

With the method according to the invention it is possible to achieve a very high output with a great simplification of plants.

Moreover, the rolling mills can either be reconverted or employed for a much wider range of products, thus increasing considerably the versatility of use and output of the rolling mills.

BRIEF DESCRIPTION OF THE DRAWING

The attached figures are given as a non-restrictive example and show some preferred solutions of the invention as follows.

Figure 3:
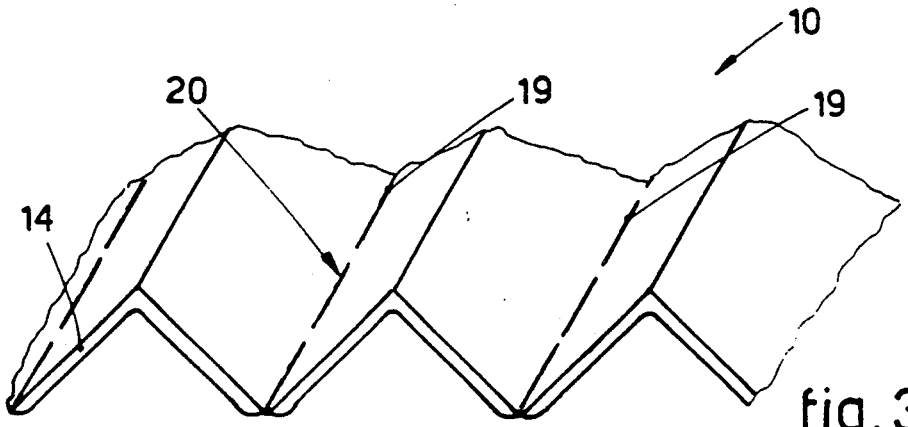
Figure 4:
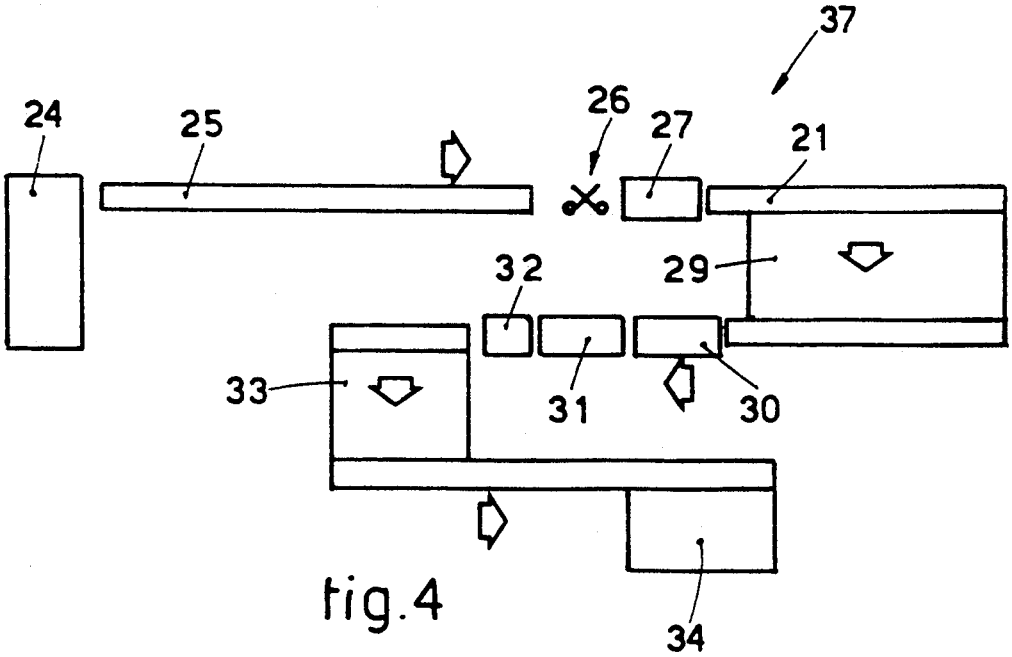

FIGS. *2a–2l* show cross-sections of some sections which can be produced with the method according to the invention;

FIG. 3 shows a three-dimensional view of a single element containing a plurality of small sections and made with the method according to the invention;

FIG. 4 shows a lay-out of a plant according to the invention.

DESCRIPTION OF THE PREFERRED EMBODIMENTS

Figure 1:
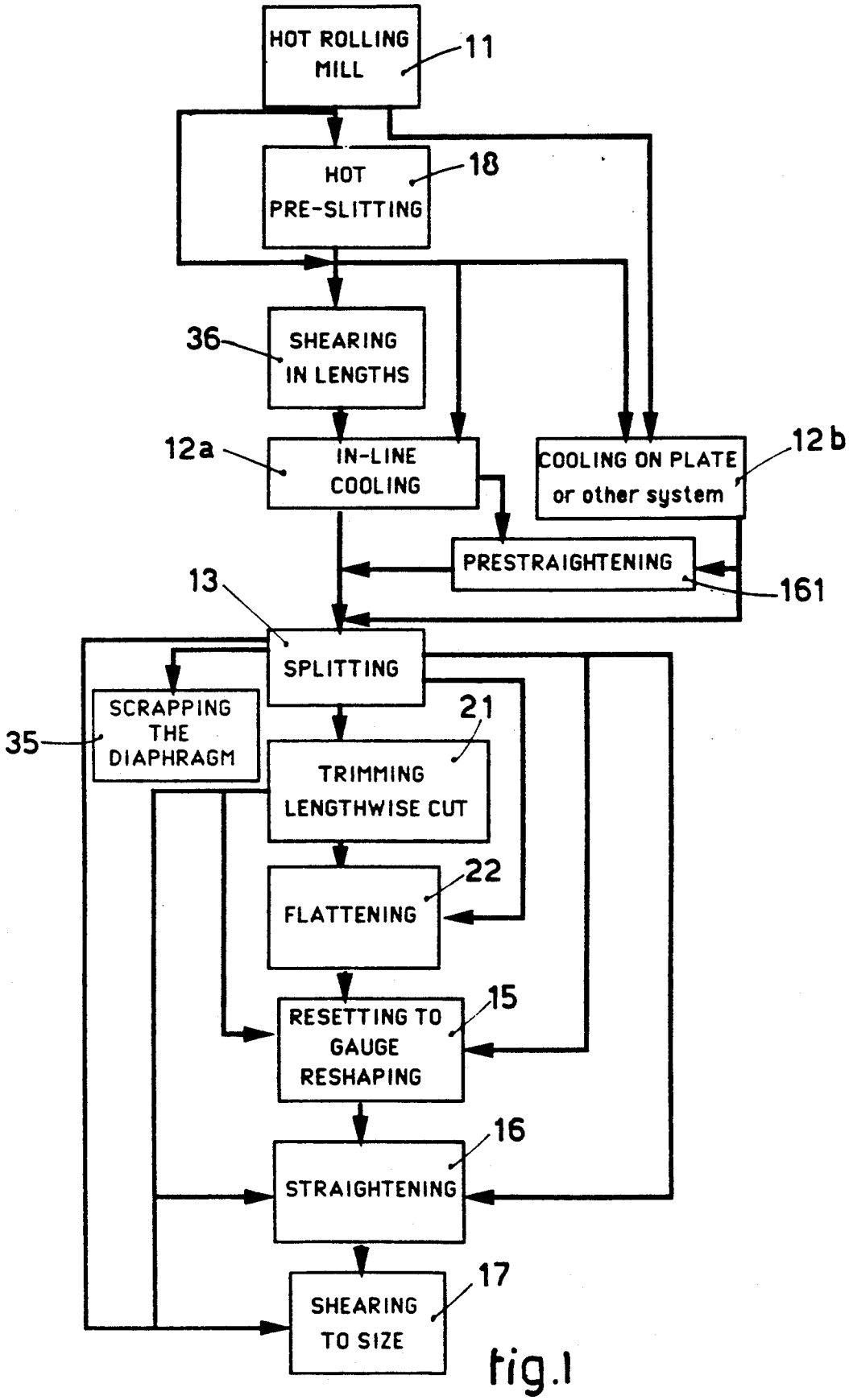
FIG. 1 shows with a block diagram the method according to the invention and makes clear some possible processing steps.

FIG. 1 gives a block diagram comprising as an example, but not restricted thereto, some possible processes which a single multiple-section element 10 consisting of sections and/or bars 14 (see, e.g., FIGS. 2c–2l and 3, undergoes in the method according to the invention.

In the method according to the invention the single multiple-section element 10 which emerges from a rolling mill 11 and which has received or now receives pre-slits 19 (see FIG. 3) in a hot pre-slitting step 18 along the lines of union 20 of the sections is cooled 12a, 12b; this cooling 12a, 12b may take place in-line 12a or on a cooling plate 12b or in another cooling assembly suitable for the purpose.

During the cooling 12a, 12b the single multiple-section element 10 may undergo a thermal treatment according to the state of the art.

The cooling 12, if it takes place in-line 12a, may be performed with air, by forced draught or otherwise, and/or in water, whether atomized or not.

The hot single multiple-section element 10, before being delivered to the cooling process 12a, 12b may possibly be sheared 36 in-line to the desired length.

As we said earlier, during the hot rolling step or immediately thereafter and always in-line, the hot single multiple-section element 10 may undergo a lengthwise pre-slitting operation 18 along the lines of the splitting 20 of the individual component sections and/or bars 14 or along the lines of the splitting 20 of the sections 14 from the web 23.

The single multiple-section element 10, after being cooled 12a, 12b in-line, is now cold and is split lengthwise in the cold state into its single component sections and/or bars 14 at one and the same time by a lengthwise slitting operation 13 along the lines of the splitting 20.

The lines of the splitting 20 at the edges of the individual cold sections 14 then undergo an operation of trimming and reshaping 21 the edge of the section.

As a web 23 (FIGS. 2b'', 2c'') may be included between the various sections and/or bars 14, the splitting action 13 will split the web 23 from the respective sections and/or bars 14 connected to the side of the web 23, and the web 23 will be sheared for scrap continuously at the same time as the splitting action 13.

According to a variant the web 23 is recovered, having its edges trimmed and being straightened.

According to another variant the single multiple-section element 10, before being split 13, undergoes a pre-straightening operation 161 so as to provide a substantially straight single multiple-section element 10.

The individual sections 14 leaving the lengthwise splitting step 13 undergo one or more of the following steps:

trimming 21 the lengthwise slit, thus cleaning away any flash along the splitting edge 20;

flattening 22 any channel sections (FIG. 2e) or T-sections (FIG. 2d) or other like sections 14, whenever it is necessary to reposition at least one wing of the section 14 to provide the section with its desired geometric position;

resetting to the correct gauge or reshaping 15 of the connecting edge so as to re-form the desired geometric figure of the connecting edge.

These successive auxiliary steps 21-22-15 are carried out in the appropriate sequence on all the sections 14 at the same time, and the sections 14 undergo also a pre-straightening operation 16 and perhaps also an operation 17 of shearing to size.

Figure 2A:
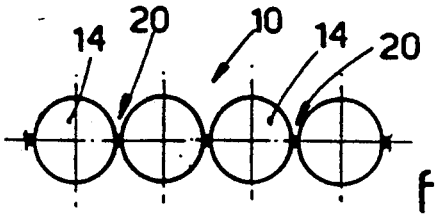

FIGS. 2a–3 show, as a non-restrictive example, some configurations of the single multiple-section element 10 comprising a plurality of individual sections 14 and leaving a rolling mill 11.

Figure 2B:
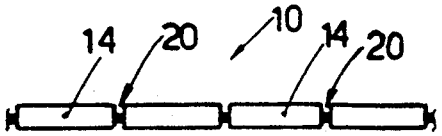
Figure 2C:
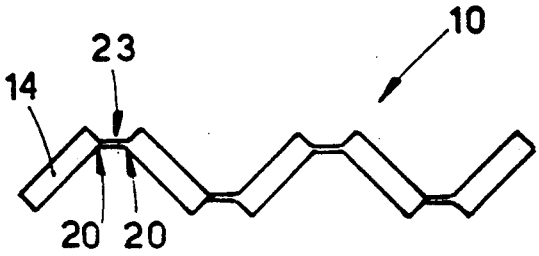
Figure 2C:
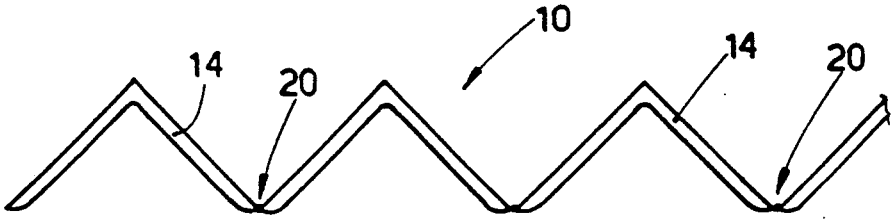
Figure 2D:
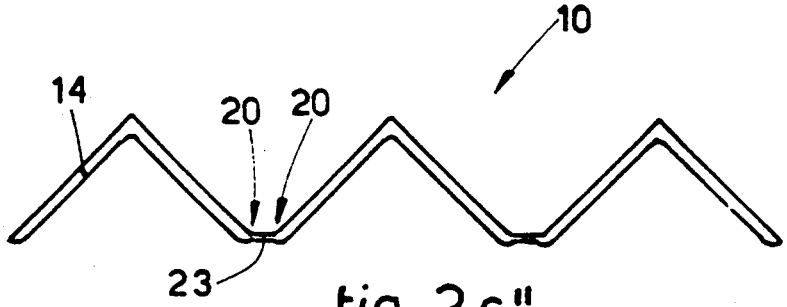
Figure 2D:
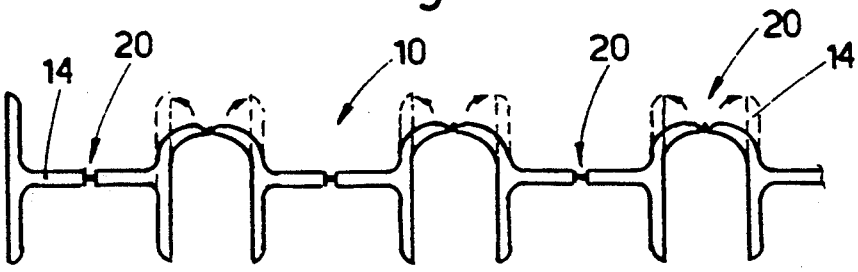
Figure 2E:
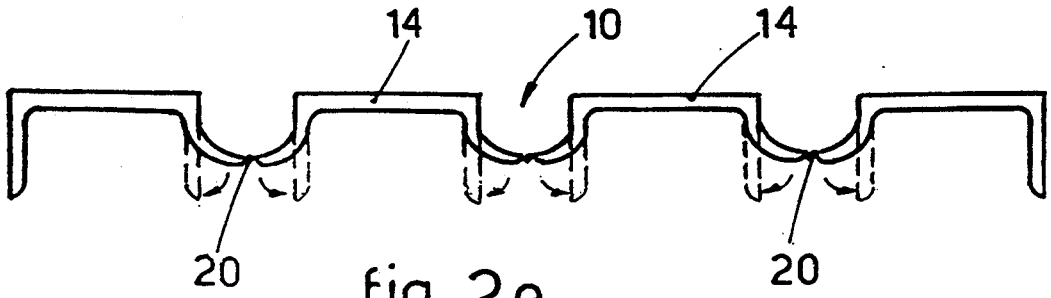

The single multiple-section element 10 is shown, as an example, without an intermediate connecting web between the sections and/or bars 14 and also with an intermediate connecting web 23 (FIGS. 2b'' and 2c).

The logic of the invention covers the provision of single multiple-section elements 10 with or without webs 23, even though the present applicants deem the inclusion of a web 23 to be preferred.

Thus, the indications which can be obtained from FIGS. 2b'' and 2c'' can be transferred also to all the cases shown and to other possible cases.

The single multiple-section element 10 may consist of a plurality of equal, symmetrical sections 14 such as, for instance, round bars (FIGS. 2b' and 2b''), instance, round bars (FIG. 2a), flat angle irons ((FIGS. 2c' and 2c''), Z-sections (FIG. 2i) and square sections (FIG. 2l), all of which are slit along the splitting line 20.

Where the single multiple-section element 10 consists of T-sections 14 (FIG. 2d) or channel sections (FIG. 2e) or other analogous sections, the sections 14 according to the invention are hot-rolled with their sides deformed so that they can form the single multiple-section element 10. In this case the sections and/or bars 14 according to the invention, when they have been split along the line 20, undergo the flattening and/or reshaping step 22 in the cold state so that they can receive their final form.

Figure 2F:
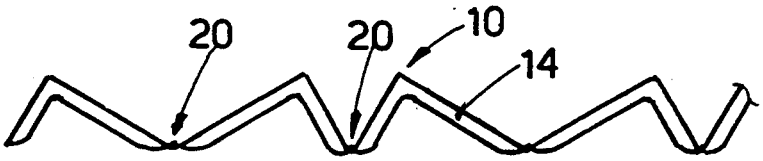

The single multiple-section element 10 may also consist of a plurality of asymmetric sections such as angle irons with unequal sides (FIG. 2f). In this case the sections 14 are included advantageously in an odd number and are arranged alternately so as to eliminate thrusts due to their asymmetric form during rolling.

Figure 2G:
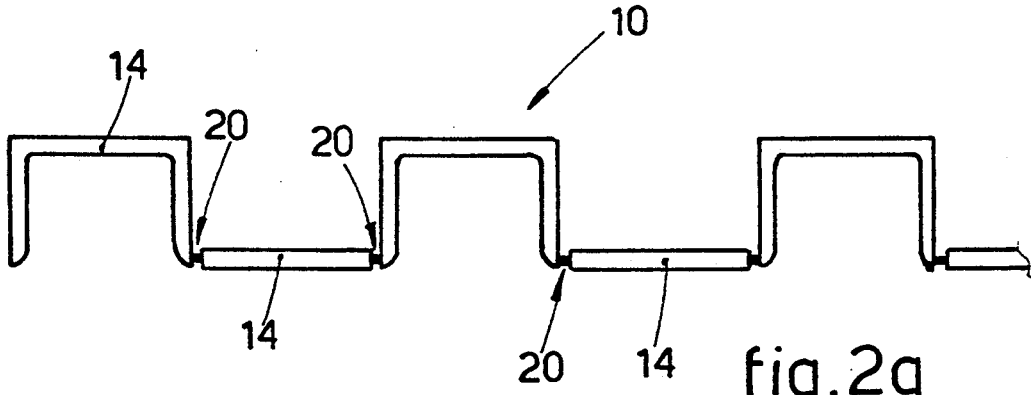
Figure 2H:
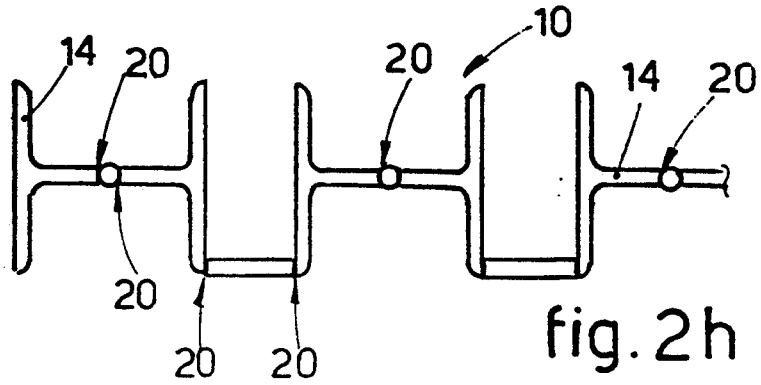
Figure 2I:
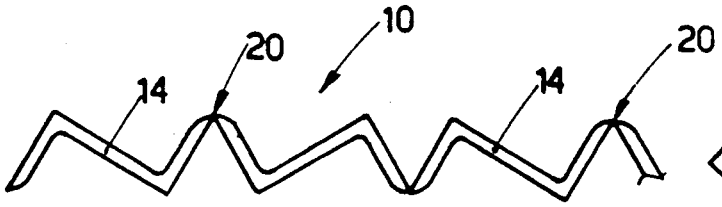
Figure 2L:
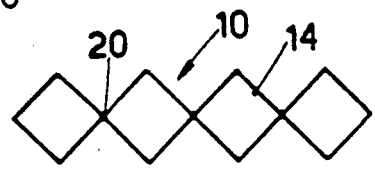

Moreover, with the method according to the invention it is also possible to produce single multiple-section elements 10 consisting of sections 14 having different cross-sections and joined together (FIGS. 2g–2h).

The single multiple-section element 10 may also be sold in the complete form as produced in the hot rolling process 11 and after being cooled 12.

The single multiple-section element 10 may also be sheared to size and straightened in that form.

Steps are taken, in line with the hot production line and downstream of the assembly to cool the multiple-section element, to carry out the simultaneous lengthwise splitting 13 in the cold state of the now cooled individual sections and/or bars 14, to reshape the edges of the same 14 and possibly to straighten 16 the individual sections and/or bars 14.

This variant is possible for any section and/or bar 14, but is especially advantageous when the sections and/or bars 14 do not require flattening and/or reshaping operations.

A plant is shown in FIG. 4 which is suitable to carry out the invention even though it may be set up with a different lay-out of the components.

FIG. 4 shows a heating or temperature-equalization furnace 24 and a known rolling line 37, which comprises, for instance, a rolling train 25, a shears 26, a straightening machine 27, a roller conveyor 28 for delivery to a cooling plate and a cooling plate 29, together with a relative discharge roller conveyor.

Immediately downstream of the cooling plate 29 or relative discharge roller conveyor is included a device 30, which performs at least the splitting 13 and setting to the correct gauge 15 steps and is followed by a straightening machine 31, which carries out the straightening action 16 on the individual sections and/or bars 14 at one and the same time.

Downstream of the straightening machine 31 is positioned a shears 32, which shears to size the individual sections and/or bars 14 and is followed by a packaging assembly 33 and a store 34 for the packages.

According to the invention a straightening machine to pre-straighten 161 the now cold single multiple-section element 10 may be included immediately upstream of the device 30.

I claim:

1. A method to obtain a plurality of sections and/or bars in a cold state, comprising:

a step of obtaining a hot-rolled multiple-section element comprising a plurality of sections and/or bars joined together lengthwise along nominal lines of splitting from a hot rolling mill, wherein said rolling mill has a size useful for typically rolling a single section or bar having a cross-sectional size within a predetermined dimensional range and wherein each of said plurality of sections and/or bars has a cross-sectional size smaller than said predetermined dimensional range;

a step of pre-slitting said hot-rolled multiple-section element lengthwise thereby providing slits completely through said hot-rolled multiple-section element discontinuously along said normal lines of splitting;

a step of cooling the pre-slit, hot-rolled multiple-section element; and a step of simultaneously lengthwise splitting, in a cold state, of the cooled, pre-slit, hot-rolled multiple-section element into a plurality of individual sections and/or bars;

wherein said steps are conducted without a break of continuity.

2. Method as claimed in claim 1, whereby the plurality of individual sections and/or bars obtained by being simultaneously split in the cold state from the cooled, pre-slit, hot rolled multiple-section element are then straightened at one time.

3. Method as claimed in claim 2, whereby before being straightened the plurality of individual sections and/or bars undergo a lengthwise trimming operation along edges thereof.

4. Method as claimed in claim 1, whereby the plurality of individual sections and/or bars obtained by being simultaneously split in the cold state from the cooled, pre-slit, hot rolled multiple-section element are then reshaped along edges thereof.

5. Method as claimed in claim 1, whereby before the step of simultaneous lengthwise splitting, the cooled pre-slit, hot rolled multiple-section element undergoes a pre-straightening operation.

6. Method as claimed in claim 1, whereby before the step of simultaneous lengthwise splitting, the cooled pre-slit, hot rolled multiple-section element undergoes an operation of being sheared to size.

7. Method as claimed in claim 1, whereby the hot rolled multiple-section element comprises asymmetric sections in an odd number.

8. Method as claimed in claim 1, whereby during the step of cooling the pre-slit, hot-rolled multiple-section element undergoes thermal treatment.

9. Method as claimed in claim 1, whereby the step of cooling takes place on a plate.

10. Method as claimed in claim 1, whereby the step of cooling takes place in line in air and/or in water.

11. Method as claimed in claim 1, whereby the cooled, pre-slit, hot rolled multiple-section element undergoes a straightening operation simultaneously with said step of lengthwise splitting.

12. Method as claimed in claim 1, wherein said step of pre-slitting is conducted during said step of obtaining a hot-rolled multiple-section element.

13. Method as claimed in claim 1, wherein said step of pre-slitting is conducted after said step of obtaining a hot-rolled multiple-section element and before said step of cooling.

14. Method as claimed in claim 1, wherein said hot-rolled multiple-section element comprises a plurality of sections joined together along adjacent sides, said multiple-section element being hot-rolled in a state in which said adjacent sides are deformed in comparison to a final desired shape of the individual sections, said method further comprising the step of reshaping deformed sides of the plurality of individual sections obtained from said step of lengthwise splitting, wherein said step of reshaping provides said plurality of individual sections with their desired form.

* * * * *